US008093812B2

(12) United States Patent
Makino et al.

(10) Patent No.: US 8,093,812 B2
(45) Date of Patent: Jan. 10, 2012

(54) PLASMA TUBE ARRAY-TYPE DISPLAY SUB-MODULE AND DISPLAY DEVICE

(75) Inventors: Tetsuya Makino, Kobe (JP); Koji Shinohe, Kobe (JP); Hitoshi Hirakawa, Kobe (JP); Kenji Awamoto, Kobe (JP)

(73) Assignee: Shinoda Plasma Co., Ltd., Kobe-Shi (JP)

( * ) Notice: Subject to any disclaimer, the term of this patent is extended or adjusted under 35 U.S.C. 154(b) by 132 days.

(21) Appl. No.: 12/486,251

(22) Filed: Jun. 17, 2009

(65) Prior Publication Data

US 2009/0315440 A1 Dec. 24, 2009

(30) Foreign Application Priority Data

Jun. 18, 2008 (JP) ..... 2008-159765

(51) Int. Cl.
*H01J 17/49* (2006.01)

(52) U.S. Cl. ..... 313/582; 313/1; 313/112

(58) Field of Classification Search ..... 313/1, 3, 313/112, 489, 582–587; 315/169.1, 169.3
See application file for complete search history.

(56) References Cited

U.S. PATENT DOCUMENTS

2006/0138924 A1* 6/2006 Park ..... 313/110
2007/0114932 A1* 5/2007 Kim ..... 313/582
2007/0194714 A1* 8/2007 Sohn ..... 313/582
2008/0024049 A1* 1/2008 Hirakawa et al. ..... 313/485
2008/0129175 A1* 6/2008 Hur et al. ..... 313/112

FOREIGN PATENT DOCUMENTS

JP 2001-141972 5/2001
JP 2003-007218 1/2003
JP 2003-338245 11/2003
WO WO2008/038377 A1 4/2008

OTHER PUBLICATIONS

English language equivalent machine translation of WO 2008/038377 A1.*

* cited by examiner

*Primary Examiner* — Joseph L Williams
*Assistant Examiner* — Andrew Coughlin
(74) *Attorney, Agent, or Firm* — Staas & Halsey LLP

(57) ABSTRACT

This invention provides a plasma tube array-type display sub-module that realizes one seamless large screen of a display device and prevents degradation in quality of an image to be displayed on the large screen. The electromagnetic wave shield layer is formed so as to extend beyond an effective display region over, where the plurality of plasma tubes is arranged on one side of the front-side supporting sheet. Moreover, at least one further function layer is formed only over the effective display region. The front-side supporting sheet with display electrodes and the electromagnetic wave shield layer is bent toward the back direction along a side end of the effective display region in order to join plasma tube array-type display sub-modules.

20 Claims, 11 Drawing Sheets

PLASMA TUBE ARRAY-TYPE DISPLAY SUB-MODULE AND DISPLAY DEVICE

CROSS-REFERENCE TO RELATED APPLICATIONS

This application claims priority to and the benefit of Japanese Application Ser. No. 2008-159765 which was filed Jun. 18, 2008, entitled Plasma Tube Array-Type Display Sub-Module and Display Device, the entirety of being hereby incorporated by reference as if fully set forth herein.

BACKGROUND OF THE INVENTION

1. Field of the Invention

The present invention relates to a plasma tube array-type display sub-module that realizes a large-screen plasma tube array-type display device joining the plurality of plasma tube array-type display sub-modules to one another, and a display device made of the plasma tube array-type display sub-module thereof. More specifically, the present invention relates to the plasma tube array-type display sub-module that allows to narrow a gap width between the adjacent plasma tube array-type display sub-modules joined to each other, and the display device made of the plasma tube array-type display sub-module thereof.

2. Description of the Related Art

As a technology for realizing a next-generation large-screen display device, a plasma tube array-type display sub-module has been developed with a structure that a plurality of plasma tubes each filled with a discharge gas is arranged in parallel. For example, a large-screen display device having a scale of several meters by several meters in size can be constructed of a plasma tube array-type display system module that the plurality of plasma tube array-type display sub-modules of 1 square-meter in size is joined to one another. The display device of such a type that the plurality of plasma tube array-type display sub-modules is joined to one another does not need either a large glass substrate to be handled, like an LCD, a PDP and the like, nor a large-scale facility and achieves even image quality at low cost. FIGS. 1A and 1B are schematic views each of which shows a specific example of a method to manufacture a conventional large display panel.

As shown in FIG. 1A, first, a plurality of plasma tube array-type display sub-modules 30*a* (front view) and 30*b* (back view) and the like is integrated with a sub-module frame and joined to each other with data IC substrates 30*c*, 30*c*, . . . attached on the back side to construct a display system module for a large screen. As shown in FIG. 1B, then, an X drive circuit 30*d*, a Y drive circuit 30*e*, and a component 30*f* including a controller, a power supply circuit and the like are incorporated in the display system module. Thus, a large display panel can be manufactured. Accordingly, it is possible to provide a large-screen display device that requires no large-scale facility investments and achieves even image quality. FIG. 2 is a perspective view which shows a schematic configuration of a plasma tube array of a conventional plasma tube array-type display sub-module.

As shown in FIG. 2, a conventional plasma tube array has a configuration that a plurality of plasma tubes 1, 1, . . . is arranged in parallel between a front-side supporting sheet 11 and a back-side supporting sheet 12, a plurality of display electrode pairs 2, 2, . . . each consisting of an X electrode and a Y electrode is formed on a rear surface of the front-side supporting sheet 11 so as to be orthogonal to the plasma tubes 1, 1, . . . and a plurality of address electrodes 3, 3, . . . is formed on an upper surface of the back-side supporting sheet 12 along the longitudinal direction of respective plasma tube 1.

The plasma tube 1, in the shape of a thin tube, includes a phosphor layer (not shown) inside, and filled with a discharge gas. Moreover, an intersection of each address electrode 3 and each display electrode pair 2 is defined as a unit light emission region or discharge cell (refer to JP 2003-338245 A).

Typically, a large-screen plasma tube array-type display device can be constructed as follows. That is, a plasma tube array-type display sub-module is prepared in such a manner that a plasma tube array is integrated with a structural body called a sub-module frame of a certain size. Then, the plurality of plasma tube array-type display sub-modules is joined to one another. Herein, the "plasma tube array-type display sub-module" refers to a display film component as described above which includes a plasma tube, that is, a semi-finished product of a display device, which does not have a drive circuit, a power supply circuit and the like incorporated.

In a case where the plasma tube array-type display sub-modules are joined horizontally to one another, however, interconnections for supplying drive power to the display electrode pair 2 and interconnections for establishing a connection from an electromagnetic wave shield layer to a ground electrode must be formed separately. The drive power is supplied in the form of an AC high voltage. Therefore, the interconnections for supplying the drive power must be formed at a predetermined distance apart from the interconnections for establishing the connection to the ground electrode, which requires a connector mechanism with a complicated structure for the joining portion thereof. FIGS. 3A and 3B are schematic sectional views on the side orthogonal to the plasma tubes each of which shows a configuration of a front optical filter group 20 of a plasma tube array-type display sub-module constructing a conventional display device. The optical filter group 20 has multi-layered construction which generally comprises a color adjusting layer 22, an infrared absorbing layer 23, an electromagnetic wave shield layer 24 and an anti reflection layer 25. Further, a black stripe layer may be incorporated. As disclosed in JP 2001-141972 A, for example, a conventional PDP (Plasma Display Panel) requires a complicated mechanism in order to assemble the optical filter group including an electromagnetic wave shield. In accordance with above conventional PDP, as shown in FIG. 3A, the front optical filter group 20 specially prepared for a large screen must be commonly attached to a front-side frame housing (not shown) or surfaces of the front-side supporting sheets 11, 11, . . . of the plasma tube array-type display sub-modules joined to one another. Accordingly, the front optical filter group 20 must be optimally designed in accordance with a combination of the plasma tube array-type display sub-modules. Further, in a case where the front optical filter group 20 is attached directly to the front-side supporting sheet 21, the display device can not be disassembled into respective plasma tube array-type display sub-modules. For this reason, it causes difficulties to dismantle in a case where installed at an event venue and the like.

In order to solve this problem, as shown in FIG. 3B, a technology has been developed to form the front optical filter group 20 for each plasma tube array-type display sub-module. However, there has been a following problem. That is, a non-display region is subject to be formed at certain intervals between the adjacent plasma tube array-type display sub-modules joined to each other. Further, the joining portion between the adjacent plasma tube array-type display sub-modules becomes twice greater in thickness than the front optical filter group 20, resulting in a high possibility that the joining portion is displayed as a black line on a screen display by the width extended where no light is emitted in the joining portion.

Moreover, it may be considered that an end of the front-side supporting sheet 21 is bent toward the rear side space between the adjacent sub-modules so that the display electrode pairs 2, 2 are connected electrically to each other and the electromagnetic wave shield layers 24, 24 are also connected electrically to each other on the back side of a display screen. Therefore, a certain gap width generates between the adjacent sub-modules corresponding to a certain thickness of the front-side supporting sheet 21 and the optical filter group 20. Accordingly, a non-display region at certain intervals is inevitably formed between the adjacent plasma tube array-type display sub-modules joined to each other. If the formed non-display region is larger than a clearance between the adjacent plasma tubes 1 and 1, a region which brightness is darker than the surroundings generates at the joining portion between the adjacent plasma tube array-type display sub-modules. Consequently, there is a possibility that the joining portion between the adjacent plasma tube array-type display sub-modules is displayed as a black line on the screen.

SUMMARY OF THE INVENTION

The present invention has been devised in view of the circumstances described above, and an object thereof is to provide a plasma tube array-type display sub-module and a display device that realizes a seamless large screen of a display device including the plurality of plasma tube array-type display sub-modules joined in parallel to one another and prevents degradation in quality of an image displayed on the large screen, and a display device that uses such a plasma tube array-type display sub-module.

In order to accomplish this object, a first aspect of the present invention is directed to a plasma tube array-type display sub-module comprising: a back-side supporting sheet having a plurality of address electrodes formed thereon; a front-side supporting sheet having a plurality of display electrodes formed on a rear surface thereof; and a plurality of plasma tubes each filled with a discharge gas, arranged in parallel and held between the back-side supporting sheet and the front-side supporting sheet, wherein an electromagnetic wave shield layer is formed on a front surface of the front-side supporting sheet so as to extend beyond an effective display region over, where the plurality of plasma tubes is arranged, at least one further functional layer is formed on the electromagnetic wave shield layer only in the effective display region, and at least one end of the front-side supporting sheet with an lead out portion of the display electrodes and the electromagnetic wave shield layer is bent toward a back direction along side ends of the effective display region to form a connecting portion to another plasma tube array-type display sub-module.

According to the first aspect of the present invention, the plurality of display electrodes is formed on the rear surface of the front-side supporting sheet. On the other hand, the electromagnetic wave shield layer is formed on the front surface of the front-side supporting sheet so as to extend beyond the effective display region over, where the plurality of plasma tubes is arranged, and the remaining functional layers (e.g., a black stripe layer, an optical filter layer, a color adjusting filter layer, an AR layer, a surface protective layer and the like) are formed only in the effective display region. Accordingly, only the front-side supporting sheet and the electromagnetic wave shield layer are bent at the end of the effective display region, leading to a reduction of a width of a joining portion between the adjacent plasma tube array-type display sub-modules joined to each other. The joining portion between the adjacent plasma tube array-type display sub-modules is made narrower in width leading to a decrease of a region which is darker than the ambient brightness and a prevention of degradation in quality of a displayed image, as the joining portion between the adjacent plasma tube array-type display sub-modules is displayed as a black line on a screen.

Moreover, a second aspect of the present invention is directed to the plasma tube array-type display sub-module according to the first aspect of the present invention, wherein the electromagnetic wave shield layer is formed by a metal layer with a mesh structure in the effective display region.

According to the second aspect of the present invention, the electromagnetic wave shield layer is formed by the metal layer with the mesh structure in the effective display region. Therefore, it is possible to satisfactorily ensure an electromagnetic wave shield function and to suppress a reduction in transmissivity of light at a minimum.

Moreover, a third aspect of the present invention is directed to the plasma tube array-type display sub-module according to the second aspect of the present invention, wherein the electromagnetic wave shield layer is formed with a pattern alternately arranged of a mesh portion and a black stripe portion in the effective display region.

According to the third aspect of the present invention, the electromagnetic wave shield layer is formed with a pattern alternately arranged of a mesh portion and a black stripe portion in the effective display region, which makes it possible to enhance a light absorbing effect by the black stripe portion as much as possible. Further, the electromagnetic wave shield layer is formed by the metal portion with the mesh structure in the effective display region, which makes it possible to satisfactorily ensure the electromagnetic wave shield function and to suppress the reduction in transmissivity of light at a minimum.

Moreover, a fourth aspect of the present invention is directed to the plasma tube array-type display sub-module according to any one of the first to third aspects of the present invention, wherein the electromagnetic wave shield layer is formed to have the whole surface as a conductive material outside of the effective display region.

According to the fourth aspect of the present invention, the electromagnetic wave shield layer is formed to have the whole surface as the conductive material outside of the effective display region to reduce a possibility of a connection failure. Therefore, it is possible to reliably establish an electrical connection between the adjacent plasma tube array-type display sub-modules.

Moreover, a fifth aspect of the present invention is directed to the plasma tube array-type display sub-module according to any one of the first to third aspects of the present invention, wherein the electromagnetic wave shield layer is formed so as to have a conductive material by a predetermined electrode pattern outside of the effective display region.

According to the fifth aspect of the present invention, the electromagnetic wave shield layer is formed so as to have the conductive material by the predetermined electrode pattern outside of the effective display region. The predetermined electrode pattern is formed in accordance with a shape of a connector. Therefore, it is possible to facilitate establishment of an electrical connection, to reduce the possibility of the connection failure, and to reliably establish the electrical connection between the adjacent plasma tube array-type display sub-modules.

Moreover, a sixth aspect of the present invention is directed to a display device comprising the plurality of plasma tube array-type display sub-modules according to any one of the first to fifth aspects of the present invention joined horizontally to one another, wherein the electromagnetic wave shield layers of the adjacent plasma tube array-type display sub-modules are formed to be connected electrically to each other.

According to the sixth aspect of the present invention, the plurality of plasma tube array-type display sub-modules is joined horizontally to one another, and the electromagnetic wave shield layers of the adjacent plasma tube array-type display sub-modules are formed to be connected electrically to each other to form the display device. Thus, the gap width of the joining portion between the adjacent plasma tube array-type display sub-modules joined to each other is made as narrow as the total thickness of the electromagnetic wave shield layer and the front-side supporting sheet. Thereby, the seam region which brightness is darker than the surroundings can be decreased. Accordingly, the display device can realize high image quality while preventing the degradation in quality of a displayed image as the joining portion between the adjacent plasma tube array-type display sub-modules is displayed as a black line on the screen.

Moreover, a seventh aspect of the present invention is directed to the display device according to the sixth aspect of the present invention, wherein a conductive material is interposed between one bent electromagnetic wave shield layer and the other adjacent bent electromagnetic wave shield layer.

According to the seventh aspect of the present invention, the conductive material interposed between one bent electromagnetic wave shield layer and the other adjacent bent electromagnetic wave shield layer can reduce, to the utmost extent to zero, the electrical resistance between the electromagnetic wave shield layers connected to each other. Further, ground potential can be made equal as the entire display device which the plasma tube array-type display sub-modules joined horizontally to one another. Accordingly, the display device can realize high image quality while suppressing the unevenness in image quality such as brightness and contrast of each plasma tube array-type display sub-module.

As described above, in the present invention, the electromagnetic wave shield layer is formed so as to extend beyond the effective display region over, where the plurality of plasma tubes is arranged, and at least one further functional layer (e.g., a black stripe layer, an optical filter layer, a surface protective layer) other than the electromagnetic wave shield layer is formed only in the effective display region. Therefore, only the front-side supporting sheet and the electromagnetic wave shield layer are bent at an adjacent end of the respective effective display region of the adjoining sub-module, leading to a reduction of the gap width of the joining portion between the adjacent plasma tube array-type display sub-modules joined to each other. The joining portion between the adjacent plasma tube array-type display sub-modules is made narrow leading to a decrease of the region which is darker than the ambient brightness and a prevention of the degradation in quality of a displayed image as the joining portion between the adjacent plasma tube array-type display sub-modules is displayed as a black line on the screen.

DESCRIPTION OF THE PREFERRED EMBODIMENTS

Figure 1A:
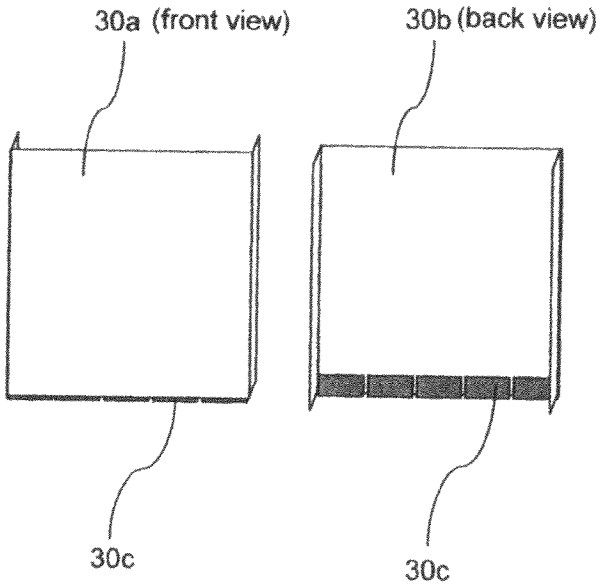
FIGS. 1A and 1B are schematic views each of which shows a specific example of a method to manufacture a conventional large display panel.
Figure 1B:
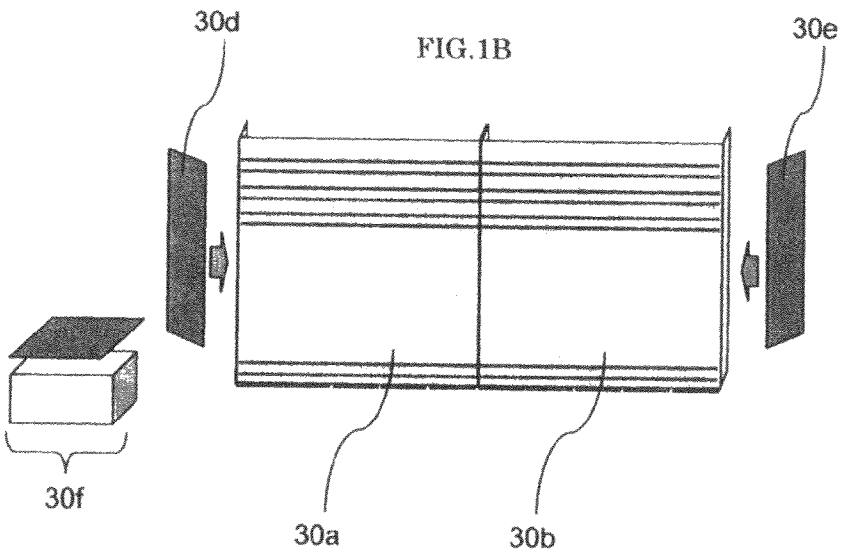
Figure 2:
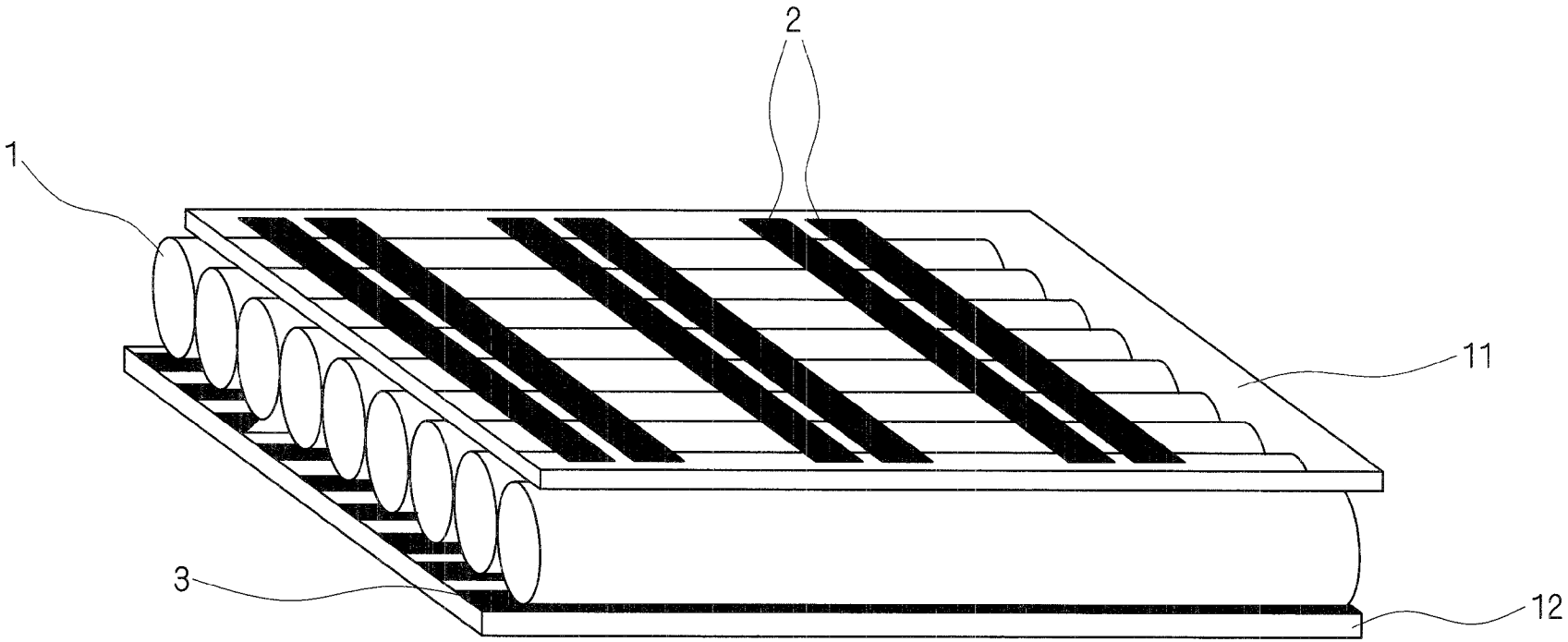
FIG. 2 is a perspective view which shows a schematic configuration of a plasma tube array of a conventional plasma tube array-type display sub-module.
Figure 3A:
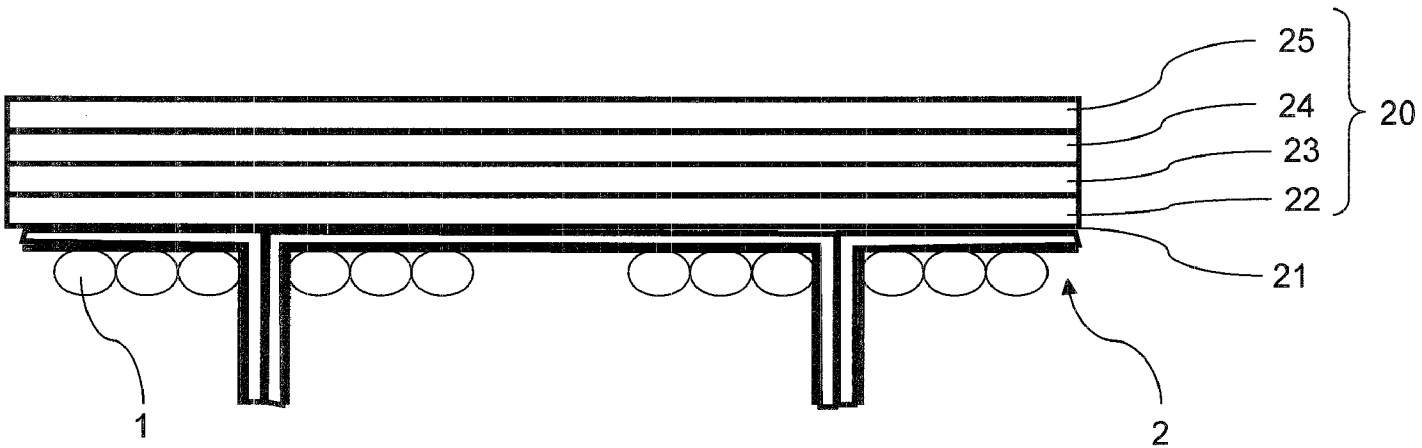
FIGS. 3A and 3B are schematic sectional views on the side orthogonal to the plasma tubes each of which shows a configuration of a front optical filter group of a plasma tube array-type display sub-module constructing a conventional display device.
Figure 3B:
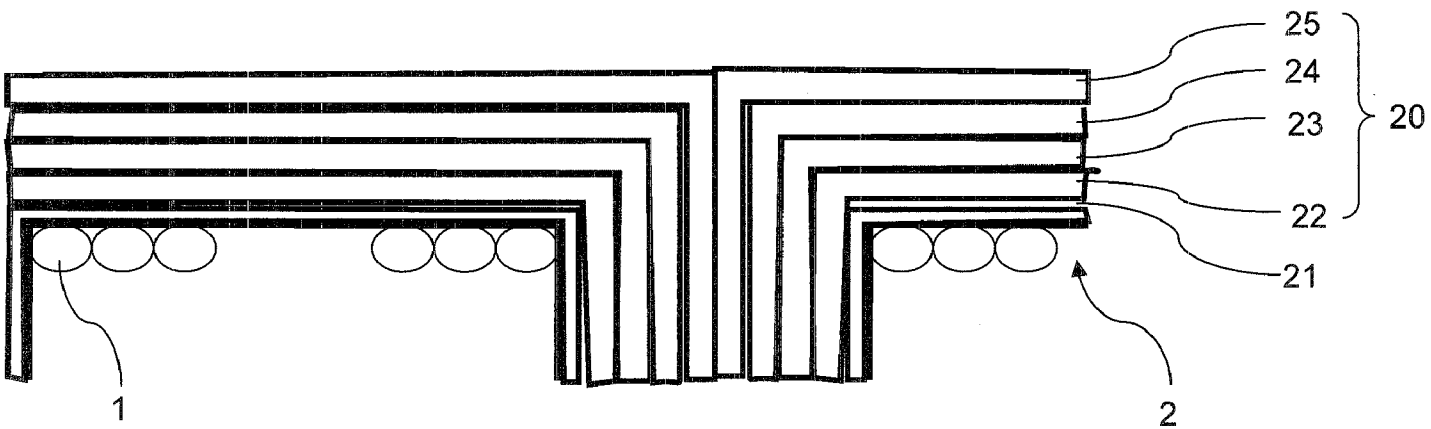
Figure 4C:
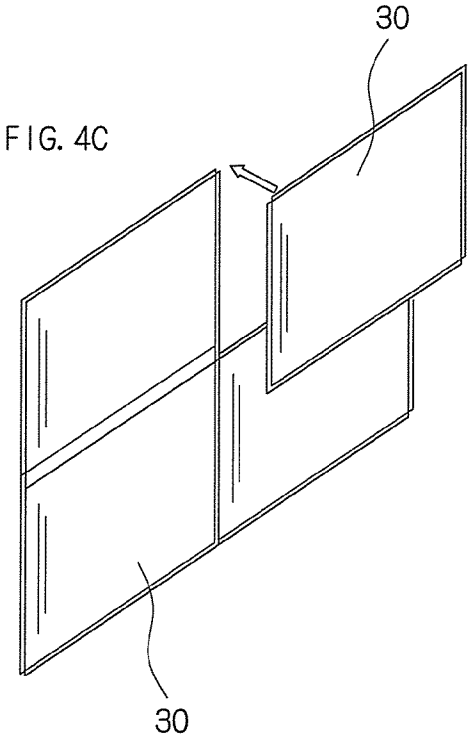
FIGS. 4A to 4C are perspective views each of which schematically shows a configuration of a plasma tube array of a plasma tube array-type display sub-module according to an embodiment of the present invention.
Figure 4A:
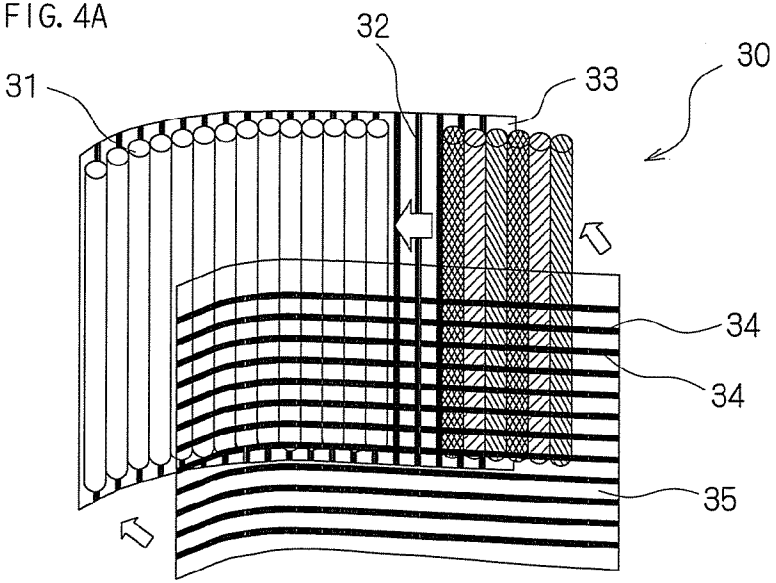
Figure 4B:
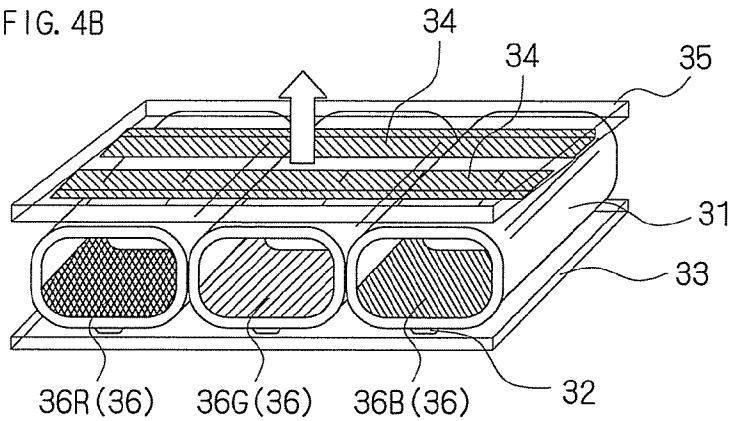

With reference to the drawings, hereinafter, detailed description will be given of a plasma tube array-type display sub-module according to an embodiment of the present invention. FIGS. 4A to 4C are perspective views each of which schematically shows a configuration of a plasma tube array of the plasma tube array-type display sub-module according to the embodiment of the present invention. More specifically, FIG. 4A is a perspective view schematically showing the configuration of the plasma tube array of the plasma tube array-type display sub-module. FIG. 4B is a perspective view partly showing the configuration of the plasma tube array of the plasma tube array-type display sub-module. FIG. 4C is a perspective view showing a state that the plurality of plasma tube array-type display sub-modules is joined vertically and horizontally to one another.

As shown in FIG. 4A, the plasma tube array-type display sub-module according to this embodiment has a rectangular shape as it comprises a part of a rectangular screen and a plurality of plasma tubes 31, 31, . . . each filled with a discharge gas is arranged in parallel. The plasma tube 31 is a discharging thin tube made of glass, which diameter is not particularly limited, but preferably about 0.5 to 5 mm. Herein, for example, the plasma tube array-type display sub-module 30 of 1 square-meter in size is constructed in such a manner that 1000 pieces of glass thin tubes each having a diameter of 1 mm, a length of 1 m and an oblate ellipsoid section are arranged in parallel by a set of several pieces. The section of the thin tube is not particularly limited in shape, and examples thereof may include a circular section, an oblate ellipsoid section, a square section and the like. Moreover, the plasma tube 31 is filled with a discharge gas such as neon, xenon and the like at a predetermined ratio at a predetermined pressure.

The plurality of plasma tubes 31, 31, . . . arranged in parallel is held between a back-side supporting sheet 33, which comprises a plurality of address electrodes 32, 32, . . . formed thereon so as to contact the lower side of the plasma tubes 31, 31, . . . in the longitudinal direction of the plasma tube 31, and a front-side supporting sheet 35 , which comprises a plurality of display electrode pairs 34, 34, . . . formed on an inner surface of the sheet so as to contact the upper side of the plasma tubes 31, 31, . . . in the direction orthogonal to the longitudinal direction of the plasma tubes 31, 31, . . . . Herein, the front-side supporting sheet 35 is a flexible sheet made of, for example, a polycarbonate film, a PET (polyethylene terephthalate) film or the like.

The plurality of display electrode pairs 34, 34, . . . is formed in stripes on an inner surface of the front-side supporting sheet 35 to contact the upper surface of the plasma tubes 31, 31, . . . so as to cross the plasma tubes 31, 31, . . . . The plurality of adjacent display electrodes 34, 34, . . . forming a display electrode pair functions as an X electrode and a Y electrode. Display discharge occurs inside the plasma tubes 31, 31, . . . between the X electrode and the Y electrode. In addition to the stripe pattern, the pattern of the display electrodes 34, 34, . . . may be a pattern which is publicly known in the relevant technical field, and examples thereof may include a mesh pattern, a ladder pattern, a comb pattern and the like. Moreover, examples of the material for the display electrode 34 may include transparent conductive materials such as ITO (Indium Tin Oxide) and $SnO_2$, and metal conductive materials such as Ag, Au, Al, Cu and Cr and the like.

The display electrode 34 can be formed by various methods which are publicly known in the relevant technical field. For example, the display electrode 34 may be formed by using a thick film technology, such as a printing, or by using a thin film technology such as a physical deposition method or a chemical deposition method. Examples of the thick film technology may include a screen print method and the like. With regard to the thin film-technology, examples of the physical deposition method may include an evaporation method, a sputtering method and the like whereas examples of the chemical deposition method may include a thermal CVD method, a photo CVD method, a plasma CVD method and the like.

The plurality of address electrodes 32, 32, . . . is formed on the back surface side of the plasma tube array-type display sub-module 30 per plasma tube 31 along the longitudinal direction of the plasma tube 31, wherein an emit light cell is formed at an intersection of the address electrode 32 and the paired display electrode 34. The address electrode 32 can be formed by various materials and methods which are publicly known in the relevant technical field.

In the configuration described above, as shown in FIG. 4B, the plasma tube array-type display sub-module 30 achieves color display in such a manner that each plasma tube 31 comprises a single-color phosphor layer 36. Examples of the phosphor layer 36, 36, . . . comprise a red (R) phosphor layer 36R, a green (G) phosphor layer 36G and a blue (B) phosphor layer 36B. A set of the plasma tube 31 comprising the red (R) phosphor layer 36R, the plasma tube 31 comprising the green (G) phosphor layer 36G and the plasma layer 31 comprising the blue (B) phosphor layer 36B forms one pixel, so that the plasma tube array-type display sub-module 30 can achieve color display. Herein, the red (R) phosphor layer 36R is made of a phosphor material such as $(Y,Gd)BO_3:EU^{3+}$ in order to emit red light by irradiation with ultraviolet rays. The green (G) phosphor layer 36G is made of a phosphor material such as $Zn_2SiO_4$:Mn in order to emit green light by irradiation with ultraviolet rays. The blue (B) phosphor layer 36B is made of a phosphor material such as $BaMgAl_{12}O_{17}:Eu^{2+}$ in order to emit blue light by irradiation with ultraviolet rays. In order to enhance flexibility of the plasma tube array-type display sub-module 30 and facilitate the assembly thereof, preferably, a plurality of the plasma tube unit each of which is prepared in such a manner that the three plasma tubes for three colors R, G, B are attached to the reed-shaped back-side supporting sheet 33 in parallel, and then the plurality of segmented plasma tube units is attached commonly to the front-side supporting sheet 35, so that the plasma tube array-type display sub-module 30 for a color display is manufactured.

The perspective view in FIG. 4C schematically shows that the plurality of plasma tube array-type display sub-modules 30, 30, . . . is joined vertically and horizontally to one another. As shown in FIG. 4C, herein, four pieces of plasma tube array-type display sub-modules 30, 30, . . . construct one plasma tube array-type display system module for a large screen. Each plasma tube array-type display sub-module 30 is a semi-finished product which does not have a drive circuit, a power supply circuit and the like incorporated. After construction of the large-screen plasma tube array-type display system module, a drive circuit, a power supply circuit and the like are incorporated in the display system module defining the whole system module as one display film. Thus, a large-screen display device can be constructed, which has a feature suppressing a variation in quality of images displayed on the respective plasma tube array-type display sub-modules 30, 30, . . . . The plasma tube array-type display sub-modules 30, 30 joined horizontally to each other can be driven simultaneously by connecting the display electrodes 34, 34 in the connection structure according to the present invention. For the plasma tube array-type display sub-modules 30, 30 joined vertically to each other, the respective address electrodes 32, 32 are lead to the upper side and the lower side of the screen so as to be connected to an address drive circuit, whereby the screens of the upper two plasma tube array-type display sub-modules 30, 30 and the screens of the lower two plasma tube array-type display sub-modules 30, 30 can be simultaneously driven by a publicly known method, so-called dual scan technique without connecting the respective address electrodes 32, 32.

However, a front-side supporting sheet providing the plurality of display electrode pairs 34, 34, . . . and an electromagnetic wave shield layer preventing a leakage of an electromagnetic wave from a surface of the screen must be bent toward the rear side space at a joining portion between the adjacent plasma tube array-type display sub-modules 30, 30. Further, the display electrodes on the front-side supporting sheet and the electromagnetic wave shield layers on the same sheet each of the adjacent plasma tube array-type display sub-modules 30, 30 must be connected electrically to each other respectively on the back side space of the screen. Therefore, it becomes very important to narrow a gap width of the joining portion between the adjacent plasma tube array-type display sub-modules 30, 30 as much as possible in order to maintain, at a high level, the quality of the image on the screen formed by the plurality of plasma tube array-type display sub-modules 30, 30, . . . joined to one another.

In the present invention, the front-side supporting sheet 35 of the plasma tube array-type display sub-module 30 is configured to narrow the gap width of the joining portion between the adjacent plasma tube array-type display sub-modules 30, 30 as much as possible. Herein, the "front-side supporting sheet" refers to a sheet or film, which supports the plurality of display electrode pairs 34, 34, . . . on the rear surface and has a multilayer structure of the electromagnetic wave shield layer and the other functional layer such as optical function or the like on the front surface.

Figure 5A:
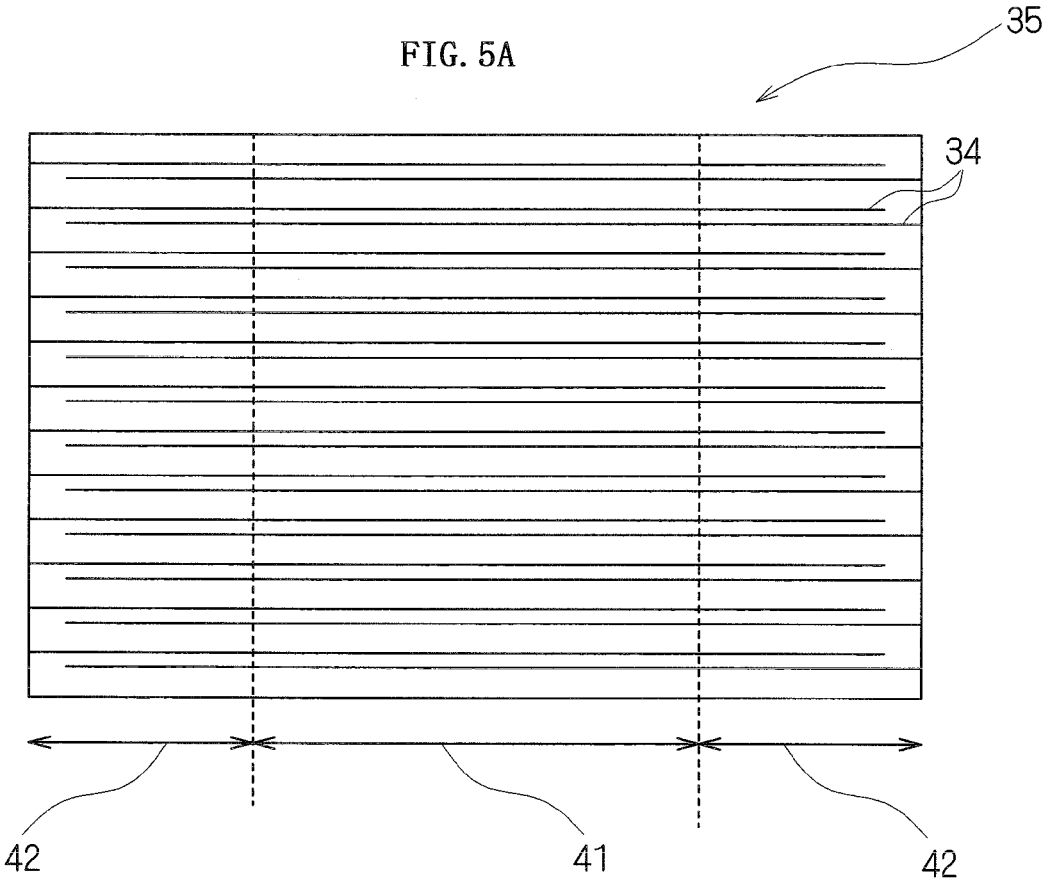
FIG. 5A is a plan view which schematically shows the configuration of the front-side supporting sheet of the plasma tube array-type display sub-module according to the embodiment of the present invention and FIG. 5B is a sectional view which schematically shows the configuration of the display electrode sheet of the plasma tube array-type display sub-module according to the embodiment of the present invention in the direction of crossing the plurality of plasma tubes.
Figure 5B:
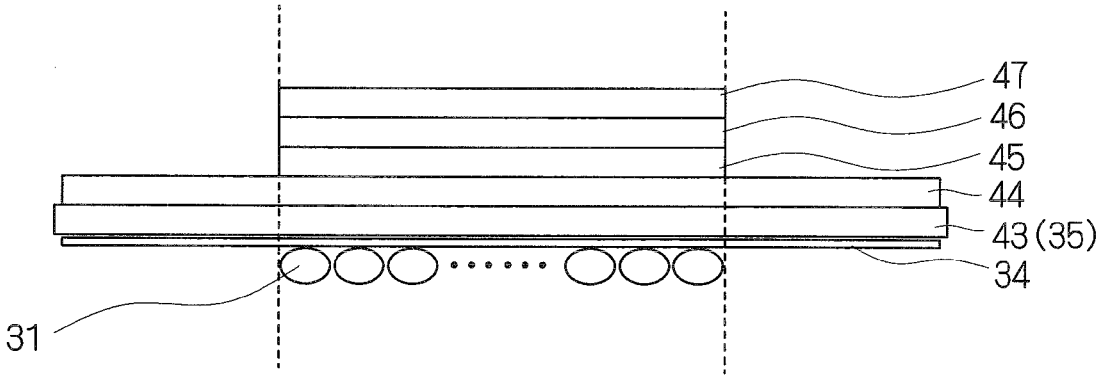

More specifically, FIG. 5A is a plan view which schematically shows the configuration of the front-side supporting sheet 35 of the plasma tube array-type display sub-module 30 according to the embodiment of the present invention. FIG. 5B is a sectional view which schematically shows the configuration of the display electrode sheet 35 of the plasma tube array-type display sub-module 30 according to the embodiment of the present invention in the direction of crossing the plurality of plasma tubes 31, 31, . . . .

As shown in FIG. 5A, the display electrode sheet 35 has a rectangular shape because the plasma tube array-type display sub-module 30 according to this embodiment comprises a part of the rectangular screen. A region where the plurality of plasma tubes 31, 31, . . . is arranged and the screen is displayed, is defined as an effective display region 41 whereas a region on both sides over the effective display region 41, that is, a region located outside the effective display region 41 is defined as an terminal region or lead out portion of the display electrodes 42.

As shown in FIG. 5B, the front-side supporting sheet 35 according to the embodiment of the present invention has the following configuration. That is, an electromagnetic wave shield layer 44 is formed so as to cover the entire effective display region 41 and extend to the lead out portion of the display electrodes 42. The forming area of the other functional layers such as a black stripe layer 45, an optical filter layer 46, a surface protective layer 47 and the like is limited only to the effective display region 41 on the electromagnetic wave shield layer 44. In this embodiment, the black stripe layer 45 has a printed pattern of a plurality of dark color stripes corresponding to the positions of a non discharge slits between the adjacent pair of display electrode. As the thickness of the black stripe layer 45 is thin, they may be formed under the electromagnetic wave shield layer 44 in a limited area corresponding to the effective display region 41. Further, it is preferable that the electromagnetic wave shield layer 44 is formed with a mesh pattern of the conductive metal film to prevent light interception. This mesh structure allows suppression of reduction in light transmittance.

In order to join the adjacent plasma tube array-type display sub-modules 30, 30 to each other, the adjacent end portion of the respective front-side supporting sheets 35, 35 in the lead out portions of the display electrodes 42, 42 is bent toward the back side space. In this case, there are only the front-side supporting sheet 43 and the electromagnetic wave shield layer 44 in the lead out portion of the display electrodes 42. Therefore, the sheet to be folded along a side edge of the plasma tube array-type display sub-module 30 is sufficiently thin. Accordingly, it is possible to narrow a gap width between the adjacent plasma tube array-type display sub-modules 30, 30.

Figure 6:
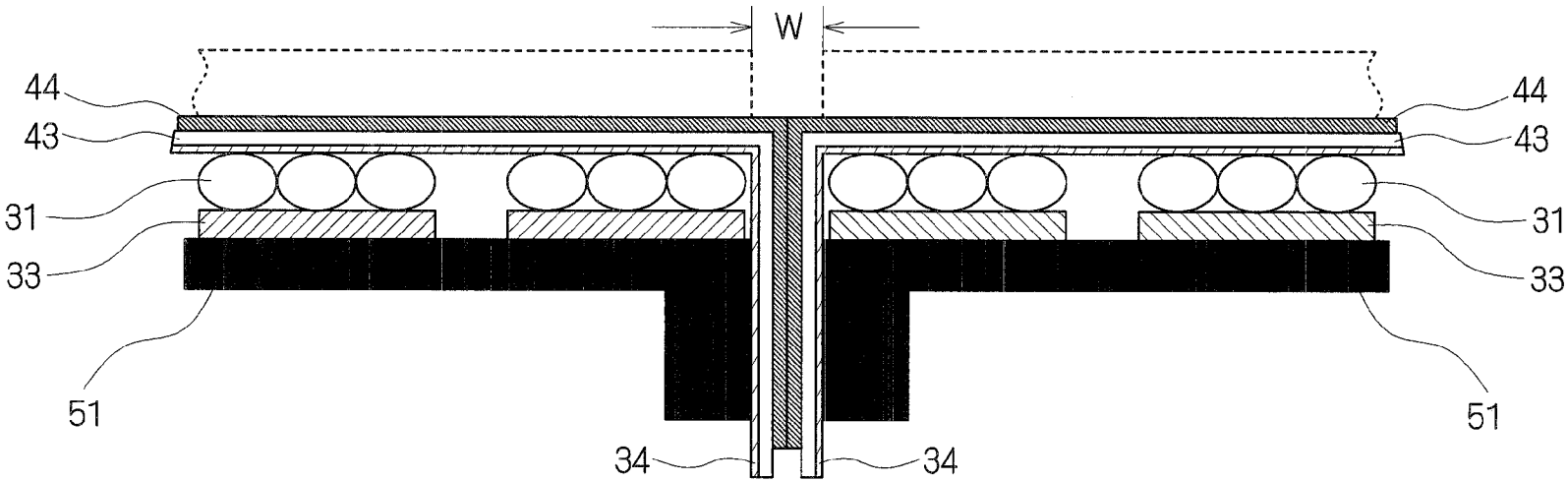
FIG. 6 is a sectional view which schematically shows a joining portion between the adjacent plasma tube array-type display sub-modules joined to one another according to the embodiment of the present invention in the direction of crossing the plurality of plasma tubes.

FIG. 6 is a sectional view which schematically shows the joining portion between the adjacent plasma tube array-type display sub-modules 30, 30 joined to one another according to the embodiment of the present invention in the direction of crossing the plurality of plasma tubes 31, 31, . . . . For simplification, in FIG. 6, the functional layers other than the electromagnetic wave shield layer 44 on the front-side supporting sheet 43 are shown by dotted line.

As shown in FIG. 6, the front-side supporting sheet 43 in the lead out portion of the display electrodes 42, is bent toward the back side space along a sub-module frame 51. In this case, there are only the front-side supporting sheet 43 and the electromagnetic wave shield layer 44 in the lead out portion of the display electrodes 42. Therefore, the gap width W of the joining portion between the adjacent plasma tube array-type display sub-modules 30, 30 is sufficiently narrow.

Herein, the adjacent electromagnetic wave shield layers 44, 44 contact automatically in the bent portion to each other, so that all the plasma tube array-type display sub-modules 30, 30, . . . are connected to one another become equal in ground potential. Thus, it is possible to avoid the unevenness as much as possible in image quality such as brightness and contrast of each plasma tube array-type display sub-module 30. Moreover, the display electrodes 34, 34 on the front-side supporting sheets 43, 43 can be connected electrically by the flexible cable (not shown) in the back space to each other, independently of the electromagnetic wave shield layers 44, 44. Accordingly, the plasma tube array-type display sub-modules 30, 30, . . . can be driven as an integrated module for a display device with sufficient shield function.

Figure 7:
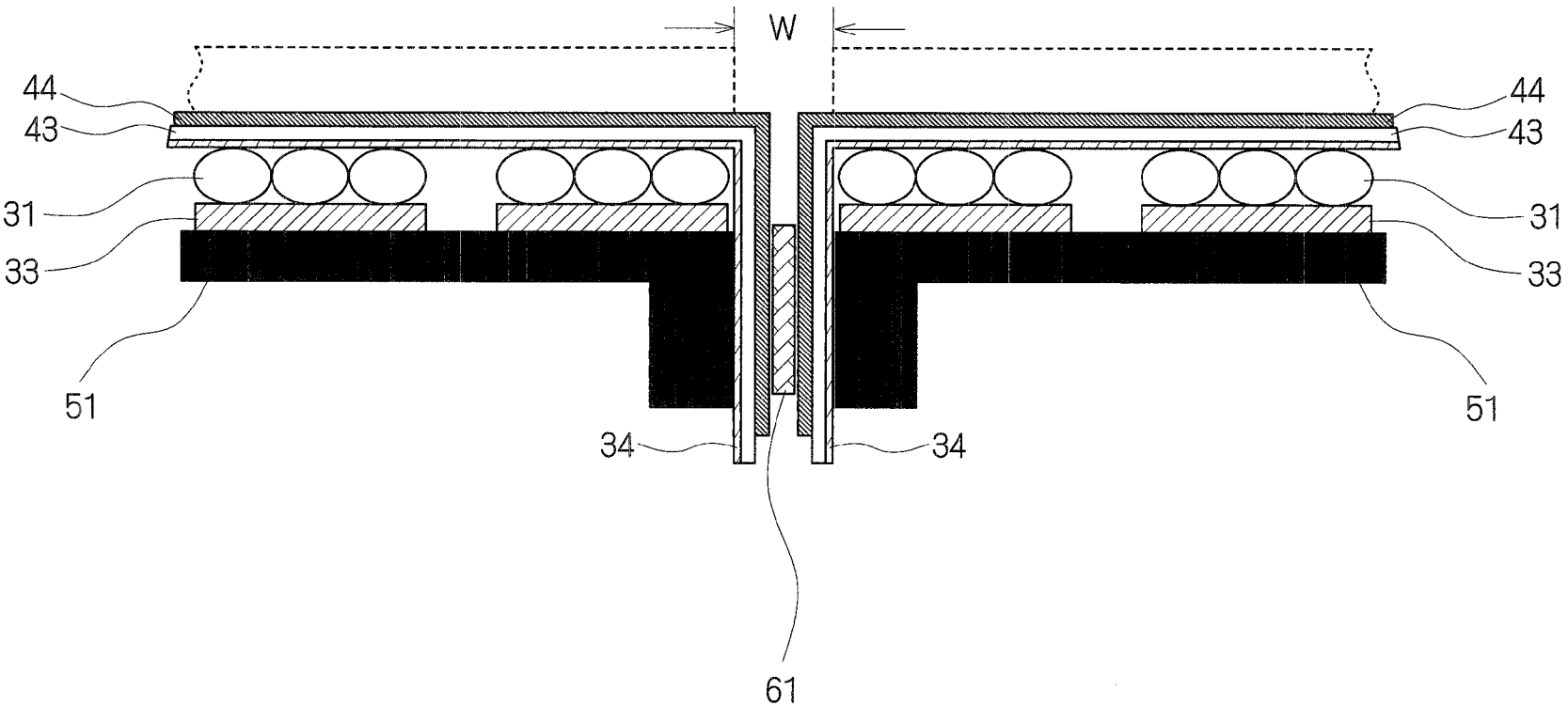
FIG. 7is a sectional view which schematically shows a joining portion between the adjacent plasma tube array-type display sub-modules according to the embodiment of the present invention with a connecting bar or tool in the direction of crossing the plurality of plasma tubes.

Alternatively, the electromagnetic wave shield layers 44, 44 are not directly connected to each other, but a connecting tool which is, for example, a flexible conductor may be held between the adjacent electromagnetic wave shield layers 44, 44. FIG. 7 is a sectional view which schematically shows the joining portion between the adjacent plasma tube array-type display sub-modules 30, 30 according to the embodiment of the present invention with the connecting bar or tool 61 in the direction of crossing the plurality of plasma tubes 31, 31, . . . .

As shown in FIG. 7, the front-side supporting sheet 43 in the lead out portion of the display electrodes 42, is bent toward the back side space along the sub-module frame 51. In this case, there are only the front-side supporting sheet 43 with display electrodes 34, 34, . . . and the electromagnetic wave shield layer 44 in the lead out portion of the display electrodes 42. Herein, a connecting bar or tool 61 which is a good conductor is held between the adjacent electromagnetic wave shield layers 44, 44 so as to provide a good contact in a range of all over the length of the plasma tube.

The connecting bar or tool 61 can reduce, to the utmost extent to zero, the electrical resistance between the adjacent electromagnetic wave shield layers 44, 44 connected to each other. Accordingly, a shield effect of the electromagnetic wave shield layer 44 is equal in any plasma tube array-type display sub-modules 30, 30, . . . , one display module which achieves even image quality as a whole can be constructed although the plurality of the plasma tube array-type display sub-modules 30, 30 is joined to one another.

Figure 8:
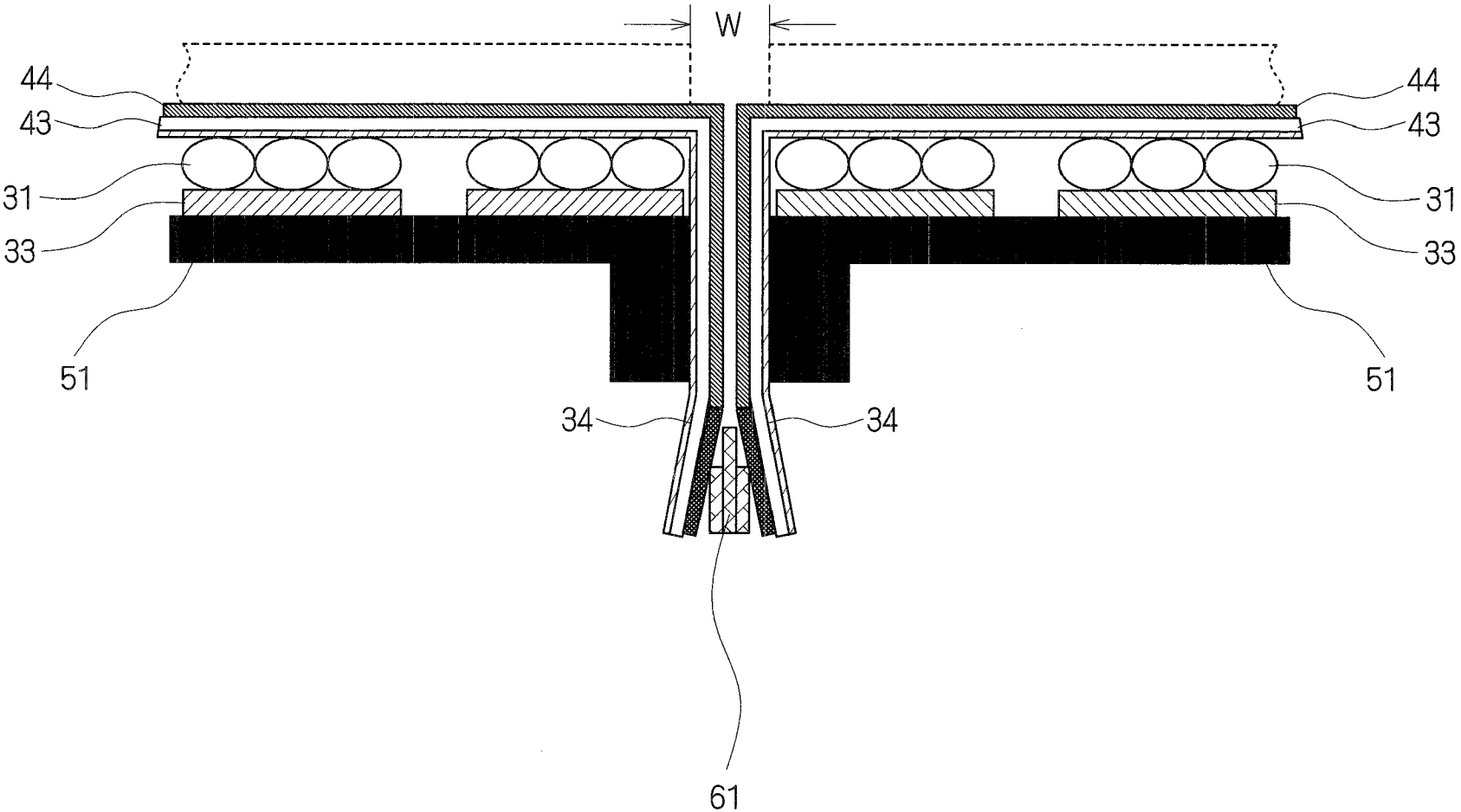
FIG. 8 is a sectional view which schematically shows the joining portion between the adjacent plasma tube array-type display sub-modules according to the embodiment of the present invention in a state that the connecting bar or tool is interposed between the adjacent plasma tube array-type display sub-modules.

In order to narrow the gap width W of the joining portion between the adjacent plasma tube array-type display sub-modules 30, 30 as much as possible, the position to hold the connecting bar or tool 61 may be shifted toward the back side space. FIG. 8 is a sectional view which schematically shows the joining portion between the adjacent plasma tube array-type display sub-modules 30, 30 according to the embodiment of the present invention in a state that the connecting bar or tool 61 is interposed between the adjacent plasma tube array-type display sub-modules 30, 30.

As shown in FIG. 8, the connecting bar or tool 61 is held at the position shifted toward the back side space of the plasma tube array-type display sub-module 30 comparing with the position shown in FIG. 7. More specifically, the end portions of the respective front-side supporting sheets 43, 43 with display electrodes 34, 34, . . . and the electromagnetic wave shield layer 44 are slightly bent toward inwardly out of the sub-module frames 51, 51. Then, the connecting bar or tool 61 is held into a wedge shape space made by this bending. On the front surface of the plasma tube array-type display sub-module 30, accordingly, the gap width W of the joining portion between the adjacent plasma tube array-type display sub-modules 30, 30 can be narrower than that shown in FIG. 7. Thus, it is possible to more effectively prevent degradation in quality of a displayed image, for example, as the joining portion between the adjacent plasma tube array-type display sub-modules 30, 30 is displayed as a black line on the screen.

Figure 9:
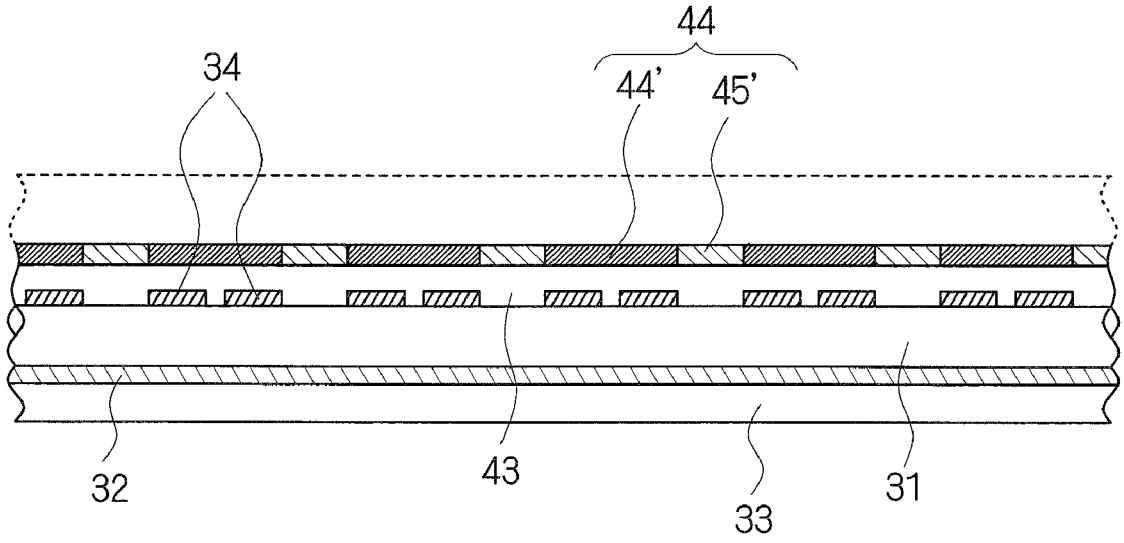
FIG. 9 is a sectional view which schematically shows a configuration of the front-side supporting sheet along the longitudinal direction of the plasma tube, in which a black stripe layer is integrated with an electromagnetic wave shield layer, of the plasma tube array-type display sub-module according to the embodiment of the present invention.

Moreover, a black stripe layer 45 absorbs light reflected irregularly, thereby reducing so-called blurring disadvantage due to interference of light and the like. It is well known that this disadvantage becomes conspicuous as the black stripe layer 45 is closer to the light emitting portion. The black stripe layer 45 is integrated with the electromagnetic wave shield layer 44 in order to suppress the blurring disadvantage more effectively. FIG. 9 is a sectional view which schematically shows a configuration of the front-side supporting sheet 43 along the longitudinal direction of the plasma tube, in which the black stripe layer 45 is integrated with the electromagnetic wave shield layer 44, of the plasma tube array-type display sub-module 30 according to the embodiment of the present invention.

Figures 10A, 10B:
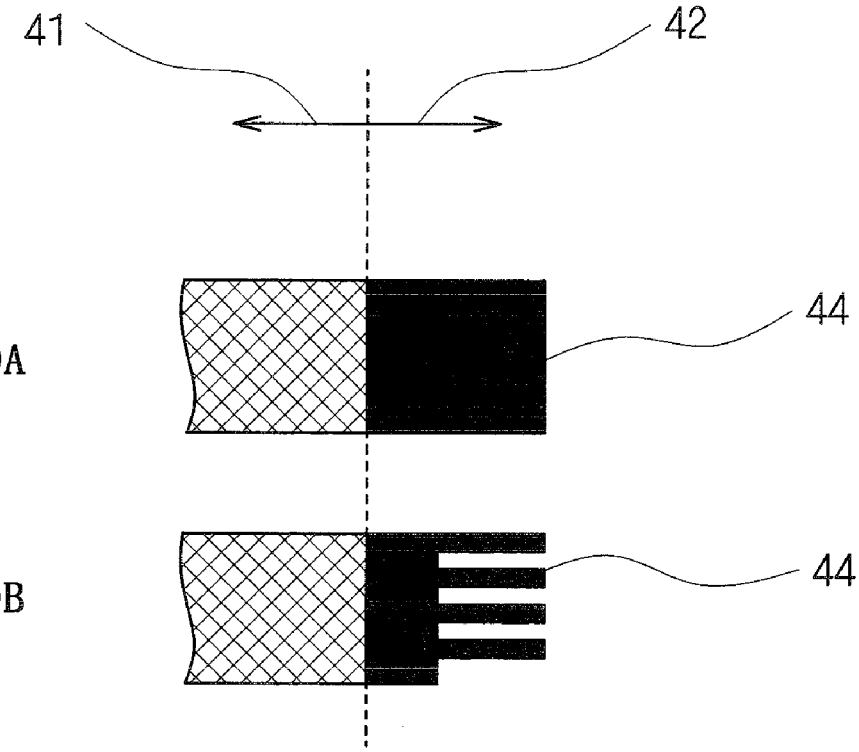
FIGS. 10A and 10B are partial plan views each of which schematically shows a configuration of the electromagnetic wave shield layer in a lead out portion of the display electrodes of the plasma tube array-type display sub-module according to the embodiment of the present invention.

As shown in FIG. 9, on the front-side supporting sheet 43 according to the embodiment of the present invention, the electromagnetic wave shield layer 44 is formed with a pattern which has a mesh portion 44' and a black stripe portion 45' alternately arranged. That is, the black stripe portion 45' and the mesh portion 44' can be integrated as a single layer 45 made of blackened metal conductive film. In this embodiment, each black stripe portion 45' is arranged in the position correspondingly the non-discharge slit between the adjacent paired display electrodes 34, and each mesh portion 44' is arranged in the discharge cells line along the pair of the display electrodes 34. In the effective display region 41, moreover, the electromagnetic wave shield layer 44 is formed so as to have a metal mesh structure, to have an evaporated metal pattern or the like. Outside of the effective display region 41, that is, in the terminal region or lead out portion of the display electrodes 42, however, the electromagnetic wave shield layer 44 does not need such a mesh structure. FIGS. 10A and 10B are partial plan views each of which schematically shows a configuration of the electromagnetic wave shield layer 44 in the lead out portion of the display electrodes 42 of the plasma tube array-type display sub-module 30 according to the embodiment of the present invention.

As shown in FIG. 10A, the end portion of the electromagnetic wave shield layer 44 in the lead out portion of the display electrodes 42 may be formed as a flat conductor (e.g., a copper foil). As shown in FIG. 10B, alternatively, the end portion of the electromagnetic wave shield layer 44 in the lead out portion of the display electrodes 42 may be formed so as to have a predetermined pattern in accordance with a shape of a connector for establishing an electrical connection with the adjacent plasma tube array-type display sub-modules 30, 30. In any case, the display device can ensure the connection with the ground electrode, make all the plasma tube array-type display sub-modules 30, 30, . . . equal in ground potential, and prevent unevenness in display.

Figure 11:
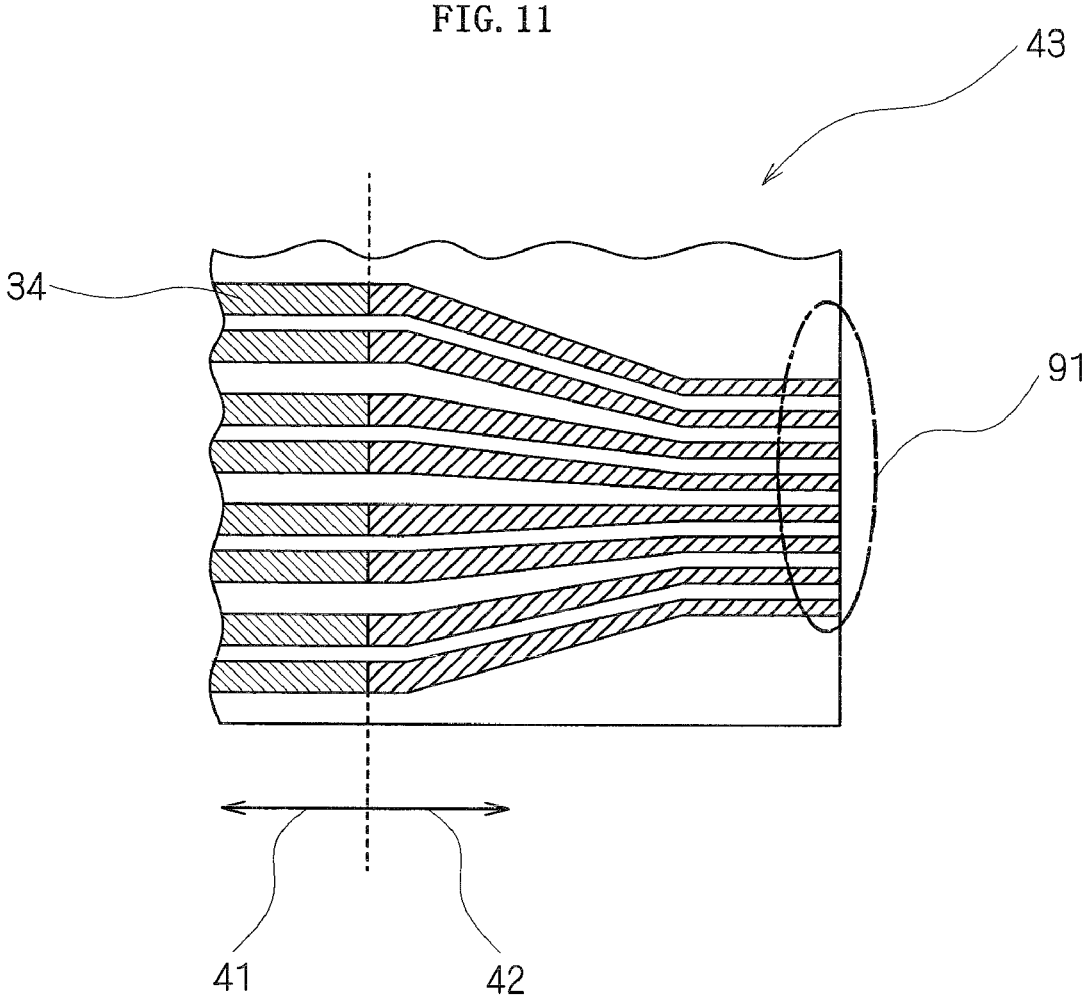
FIG. 11 is an illustration which schematically shows a configuration of a front-side supporting sheet in the lead out portion of the display electrodes according to the embodiment of the present invention.

FIG. 11 is an illustration which schematically shows the configuration of the front-side supporting sheet 43 in the lead out portion of the display electrodes 42 according to the embodiment of the present invention. In the effective display region 41, the plurality of display electrode pairs 34, 34, . . . is formed linearly at certain intervals. Outside of the effective display region 41, that is, in the lead out portion of the display electrodes 42, preferably, the plurality of display electrode pairs 34, 34, . . . can deform in accordance with the shape of the connector for establishing the electrical connection with the adjacent plasma tube array-type display sub-modules 30, 30. With this configuration, the plasma tube array-type display sub-module 30 can readily and reliably ensure the electrical connection with the adjacent plasma tube array-type display sub-module 30. For example, in a case where the connector has an predetermined electrode receiving portion aggregated within a region 91, the plurality of display electrode pairs 34, 34, . . . on the front-side supporting sheet 43 may be bent in the lead out portion of the display electrodes 42 so as to be within the region 91.

According to this embodiment as described above, the gap width of the joining portion between the adjacent plasma tube array-type display sub-modules 30, 30 joined to each other can be reduced. The joining portion between the adjacent plasma tube array-type display sub-modules 30, 30 is made narrow, leading to a decrease of the region which brightness is darker than the surroundings and a prevention of the degradation in quality of a displayed image, as the joining portion between the adjacent plasma tube array-type display sub-modules 30, 30 is displayed as a black line on the screen.

It is needless to say that numerous modifications and variations can be devised without departing from the scope of the present invention.

What is claimed is:

1. A plasma tube array-type display sub-module comprising:

a back-side supporting sheet having a plurality of address electrodes formed thereon;

a front-side flexible supporting sheet having a plurality of display electrodes formed on a rear surface thereof; and an array comprising a plurality of plasma tubes each filled with a discharge gas, arranged in parallel and held between the back-side supporting sheet and the front-side flexible supporting sheet, wherein an electromagnetic wave shield layer is formed on a front surface over the array of the plasma tubes of the front-side flexible supporting sheet so as to extend beyond an effective display region of the plasma tube array-type display sub-module, at least one further functional layer is formed on the electromagnetic wave shield layer only in the effective display region of the plasma tube array-type display sub-module, and at least one end of the front-side flexible supporting sheet with a lead out portion of the display electrodes and the electromagnetic wave shield layer is bent toward a back direction along side ends of the effective display region through a gap between the plasma tube array-type display sub-module and another sub-module adjacent to the plasma tube array-type display sub-module, the electromagnetic wave shield layer having a connecting portion in a back-to-back arrangement with respect to an electromagnetic wave shield layer of the another sub-module.

2. The plasma tube array-type display sub-module according to claim 1, wherein the electromagnetic wave shield layer is formed by a metal layer with a mesh structure in the effective display region.

3. The plasma tube array-type display sub-module according to claim 2, wherein the electromagnetic wave shield layer is formed with a pattern alternately arranged of a mesh portion and a black stripe portion in the effective display region.

4. The plasma tube array-type display sub-module according to claim 3, wherein the electromagnetic wave shield layer is formed to have the whole surface as a conductive material outside of the effective display region.

5. The plasma tube array-type display sub-module according to claim 3, wherein the electromagnetic wave shield layer is formed so as to have a conductive material by a predetermined electrode pattern outside of the effective display region.

6. A display device comprising:

the plurality of plasma tube array-type display sub-modules according to claim 3 joined horizontally to one another, wherein the electromagnetic wave shield layers of the adjacent plasma tube array-type display sub-modules are formed to be connected electrically to each other.

7. The plasma tube array-type display sub-module according to claim 2, wherein the electromagnetic wave shield layer is formed to have the whole surface as a conductive material outside of the effective display region.

8. The plasma tube array-type display sub-module according to claim 2, wherein the electromagnetic wave shield layer is formed so as to have a conductive material by a predetermined electrode pattern outside of the effective display region.

9. A display device comprising:

the plurality of plasma tube array-type display sub-modules according to claim 2 joined horizontally to one another, wherein the electromagnetic wave shield layers of the adjacent plasma tube array-type display sub-modules are formed to be connected electrically to each other.

10. The display device according to claim 9, wherein a conductive material is interposed between one bent electromagnetic wave shield layer and the other adjacent bent electromagnetic wave shield layer.

11. The display device according to claim 6, wherein a conductive material is interposed between one bent electromagnetic wave shield layer and the other adjacent bent electromagnetic wave shield layer.

12. The plasma tube array-type display sub-module according to claim 1, wherein the electromagnetic wave shield layer is formed to have the whole surface as a conductive material outside of the effective display region.

13. A display device comprising:

the plurality of plasma tube array-type display sub-modules according to claim 12 joined horizontally to one another, wherein the electromagnetic wave shield layers of the adjacent plasma tube array-type display sub-modules are formed to be connected electrically to each other.

14. The display device according to claim 13, wherein a conductive material is interposed between one bent electromagnetic wave shield layer and the other adjacent bent electromagnetic wave shield layer.

15. The plasma tube array-type display sub-module according to claim 1, wherein the electromagnetic wave shield layer is formed so as to have a conductive material by a predetermined electrode pattern outside of the effective display region.

16. A display device comprising:

the plurality of plasma tube array-type display sub-modules according to claim 15 joined horizontally to one another, wherein the electromagnetic wave shield layers of the adjacent plasma tube array-type display sub-modules are formed to be connected electrically to each other.

17. The display device according to claim 16, wherein a conductive material is interposed between one bent electromagnetic wave shield layer and the other adjacent bent electromagnetic wave shield layer.

18. A display device comprising:

the plurality of plasma tube array-type display sub-modules according to claim 1 joined horizontally to one another, wherein the electromagnetic wave shield layers of the adjacent plasma tube array-type display sub-modules are formed to be connected electrically to each other.

19. The display device according to claim 18, wherein a conductive material is interposed between one bent electromagnetic wave shield layer and the other adjacent bent electromagnetic wave shield layer.

20. The display device according to claim 1, wherein the functional layer is a black stripe layer.

* * * * *

UNITED STATES PATENT AND TRADEMARK OFFICE

CERTIFICATE OF CORRECTION

PATENT NO. : 8,093,812 B2
APPLICATION NO. : 12/486251
DATED : January 10, 2012
INVENTOR(S) : Makino et al.

It is certified that error appears in the above-identified patent and that said Letters Patent is hereby corrected as shown below:

Column 14, Line 46, In Claim 20, delete "display device" and insert -- plasma tube array-type display sub-module --, therefor.

Signed and Sealed this
Twenty-ninth Day of May, 2012

David J. Kappos

David J. Kappos
*Director of the United States Patent and Trademark Office*